US007449873B2

(12) United States Patent
Schaffer et al.

(10) Patent No.: US 7,449,873 B2
(45) Date of Patent: Nov. 11, 2008

(54) VOLTAGE CONTROLLED CURRENT SOURCE DEVICE

(75) Inventors: Viola Schaffer, Erlangen (DE); Rodney T. Burt, Tucson, AZ (US); Jürgen Metzger, Pliezhausen (DE)

(73) Assignee: Texas Instruments Deutschland GmbH, Freising (DE)

( * ) Notice: Subject to any disclaimer, the term of this patent is extended or adjusted under 35 U.S.C. 154(b) by 219 days.

(21) Appl. No.: 11/383,320

(22) Filed: May 15, 2006

(65) Prior Publication Data

US 2006/0255787 A1 Nov. 16, 2006

(30) Foreign Application Priority Data

May 13, 2005 (DE) ..... 10 2005 022 337

(51) Int. Cl.
*G05F 3/16* (2006.01)

(52) U.S. Cl. ..... 323/315

(58) Field of Classification Search ..... 323/312, 323/315; 327/530, 534, 538
See application file for complete search history.

(56) References Cited

U.S. PATENT DOCUMENTS

| | | | | |
|---|---|---|---|---|
| 4,185,236 | A | 1/1980 | van de Plassche et al. | |
| 6,020,728 | A | 2/2000 | Thus et al. | |
| 6,348,780 | B1 | 2/2002 | Grant | |
| 6,388,507 | B1 * | 5/2002 | Hwang et al. | 327/538 |
| 6,525,515 | B1 | 2/2003 | Ngo et al. | |
| 6,819,093 | B1 | 11/2004 | Kay | |
| 7,127,061 | B2 * | 10/2006 | Gregorius | 379/399.01 |
| 7,154,923 | B2 * | 12/2006 | Kucharski | 372/29.015 |
| 2002/0000889 | A1 | 1/2002 | Kim | |
| 2003/0071678 | A1 | 4/2003 | Paulus | |
| 2005/0077972 | A1 | 4/2005 | Oehm | |

FOREIGN PATENT DOCUMENTS

| | | | |
|---|---|---|---|
| DE | 100 28 098 | C2 | 12/2001 |
| EP | 0 359 315 | A1 | 3/1990 |

* cited by examiner

*Primary Examiner*—Adolf Berhane
(74) *Attorney, Agent, or Firm*—Warren L. Franz; Wade J. Brady, III; Frederick J. Telecky, Jr.

(57) ABSTRACT

An integrated voltage controlled current source device is provided, that extends the high accuracy, low drift output current over a large current range, and provides more headroom and better power efficiency than the standard shunt resistor and INA (instrumentation amplifier) current source arrangement. The device has a control voltage input, a load current output and a current set terminal for a connection of a current set resistor. It contains a selected leg biasing set voltage, corresponding to a control voltage applied to the control voltage input of a regulating driver amplifier providing a regulated voltage to be applied across the current set resistor, thereby causing a reference current to flow through the current set resistor and selected leg(s) of a current mirror. Furthermore, the device contains a dynamically matched current mirror that mirrors the reference current to the load output current. The algorithm for selecting the current mirror legs may be a pseudo-random or a defined pattern.

18 Claims, 4 Drawing Sheets

VOLTAGE CONTROLLED CURRENT SOURCE DEVICE

FIELD OF THE INVENTION

The invention relates to a voltage controlled current source device, in particular with an integrated circuit.

BACKGROUND OF THE INVENTION

Voltage controlled current source applications typically use a shunt resistor in series with the output load to sense the load current. The load current is fed to an instrumentation amplifier (INA) to measure the voltage drop across the shunt resistor and to feed it back to the input, thereby closing the control loop.

With this approach, which is widely used, to achieve good accuracy both the (shunt) resistor and the INA must have high accuracy and low drift. This leads to additional cost and board space. Furthermore, the voltage drop across the shunt resistor reduces the voltage headroom to the load and the power efficiency. In addition, the range of the current for an accurate output is limited. For small current levels through the shunt resistor, errors of the INA dominate; whereas, for large current levels, the voltage headroom and power efficiency to the load are reduced. As the potential at the load can change significantly, the INA must have a high common mode rejection which requires a trim of the common mode rejection ratio (CMRR). Finally, due to multiple stages of the feedback loop, an additional compensation is necessary. This requires the application to be overcompensated, which leads to a reduced performance.

SUMMARY OF THE INVENTION

The invention provides a voltage controlled current source device that overcomes the aforementioned limitations.

Specifically, a voltage controlled current source device is provided, in particular with an integrated circuit, that has a control voltage input and a load current output. The device comprises a current set terminal for a connection of a current set resistor. It contains a selected leg gate biasing set voltage, corresponding to a control voltage applied to the control voltage input of a regulating driver amplifier providing a regulated voltage to be applied across the current set resistor, thereby causing a reference current to flow through the current set resistor and selected leg(s) of a current mirror. Furthermore, the device contains a current mirror that mirrors the reference current from the selected leg(s) of the current mirror to the load output current.

As the reference current is mirrored to the load in a feed-forward arrangement, in particular via a dynamically matched current mirror, there is no need for a current control loop with a shunt resistor and an instrumentation amplifier (INA). In particular, a dynamic element matching approach employed in the current mirror ensures high accuracy throughout a large range of the output current. Limitations to the voltage headroom or power efficiency at high output currents are eliminated. Although the driver which determines the current forced through the current set resistor preferably includes an operational amplifier which is part of a closed control loop, the feedback loop is short, which leads to a fast application. Typically, no additional (external) compensation is required for that loop.

In an embodiment, the current mirror includes multiple current sources all having the same gate bias supplied by said driver. At least one of the current sources is connected to supply the reference current to the current set resistor. Furthermore, all other current sources are connected to mirror the reference current to the load current output.

In a more detailed implementation, a clock-controlled switching arrangement is provided that cycles the at least one current source, connected to supply the reference current, through all of the current sources in the current mirror. This cycling can be done pseudo-randomly or following a certain pattern, e.g., to make sure that all current sources are selected a substantially equal number of times.

For an application that requires positive or negative current output from the same device, the multiple current sources are divided into a first group and into a second group of current sources, wherein at least one current source of each group is connected to supply said reference current to said current set resistor. All other current sources within each group of current sources can be connected in such a way that they mirror the reference current to the load current output. The current sources of the first group are of p-type and the current sources of the second group are of n-type. A clock-controlled switching arrangement cycles the connection of the at least one current source of each group to supply the reference current through all of the current sources of the respective group.

In a further embodiment the ratio between the number of the at least one current source and the number of all the other current sources is adjustable, e.g., by pre-selection or dynamically. This allows to adjust the ratio of the current gain of the current mirror.

For applications that require a high output voltage or high impedance, the reference current is supplied to the current set resistor through an input cascode arrangement and the load output current is supplied to the load current terminal through an output cascode arrangement. The transistors in the current mirror legs may be cascoded or degenerated by corresponding resistors to increase impedance and decrease the variability of the output current .

BRIEF DESCRIPTION OF THE DRAWINGS

Example embodiments of the invention are shown in the accompanying drawings, wherein.

DETAILED DESCRIPTION OF EMBODIMENTS

Figure 1:
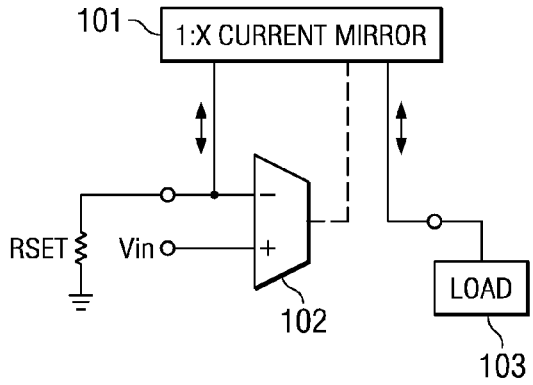
FIG. 1 is a block diagram of a voltage controlled current source device.

With reference to FIG. 1, an example integrated circuit implementation of a voltage controlled current source device comprises a current set resistor RSET, a current mirror block 101, a driver including an operational amplifier 102 with a negative and a positive input and an output. The current set resistor RSET may be off-chip or on-chip as part of the integrated circuit. The current set resistor RSET is connected across the negative input of the amplifier 102 and ground GND or, as an alternative, another reference voltage instead of ground GND. A control voltage Vin is applied to the positive input of the amplifier 102. The current mirror block 101 has a first output connected to the negative input of the amplifier 102 and a second output connected to a load 103. The output of the amplifier 102 provides a gate control voltage to the current mirror block 101.

The current mirror block 101 comprises multiple current sources, all having the same gate bias supplied by the output of amplifier 102. At any time, at least one of the current sources of the current mirror block 101 is connected to supply the reference current to the current set resistor RSET. All other current sources of the current mirror 101 are connected to mirror the reference current to the load current output towards the load 103. Thus, the current mirror 101 provides a current gain ratio based on the number of current sources connected to supply the reference current to the current set resistor RSET and based on the number of current sources connected to mirror the reference current towards the load 103. In the example shown, a ratio of 1:X means that a total of 1+X current sources are provided; wherein one current source is connected to supply the reference current to the current set resistor RSET and X current sources are connected to mirror the current to the load current output. It is to be noted that with regard to the ratio "1:X", "X" does not need to be an integer and/or "1" does not need to mean "one" current source only. In other words, implementations with a ratio of "3:10", "4:20", "8:2", etc., are also possible.

In a preferred embodiment, to increase the accuracy for the current mirror, a method of dynamic element matching is applied. This is achieved by providing a clock-controlled switching arrangement which cycles the (at least one) current source connected to supply the reference current through all of the current sources of the current mirror. Transistor mismatch due to process variation can be significantly reduced by providing X+I identical transistors as current sources and periodically switching (permutating) the selection of transistors that are actually connected to each side of the current mirror. The patterning, cycling among transistors can be done pseudo-randomly or following a definite pattern, e.g., to make sure that all current sources are selected a substantially equal number of times.

Figure 2:
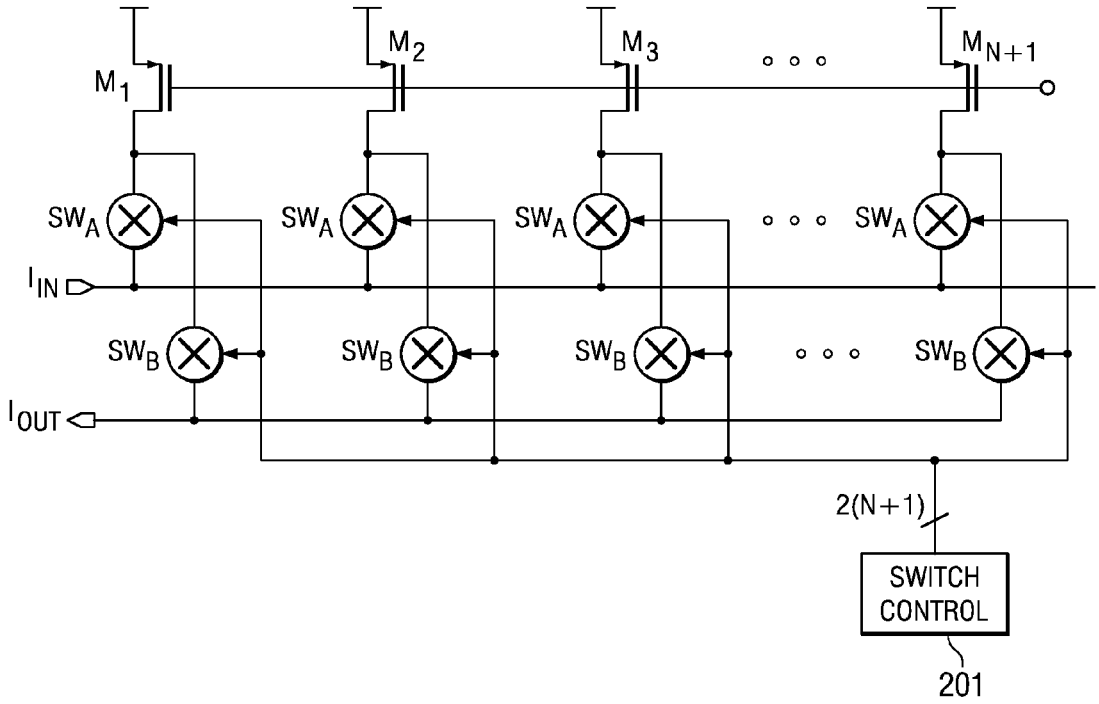
FIG. 2 shows an example circuit embodiment with a plurality of current sources.

FIG. 2 shows an exemplary circuit with multiple current sources $M_1, \ldots, M_{N+1}$. The current sources are PMOS transistors, the Sources of which are connected to a positive power supply rail. The Gates of the current sources are connected with each other and with a bias source. A current output $I_{OUT}$ or a current input $I_{IN}$ can be connected to the Drain of each PMOS transistor. Such connection is controlled by a switch control 201. Hence, each PMOS transistor has two switches $SW_A$ and $SW_B$ in series with its Drain, that allow the Drain to be connected to either the input mirror leg or the output mirror leg.

Figure 3:
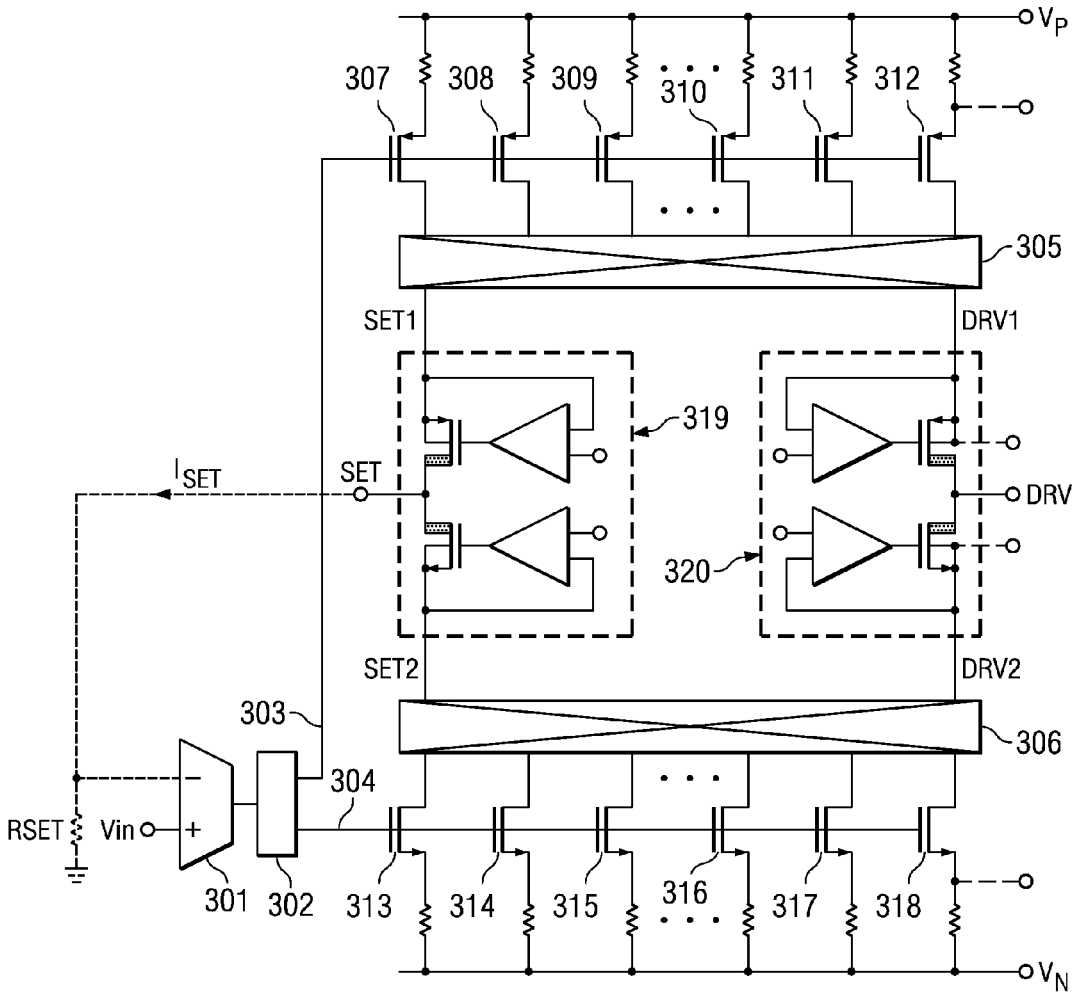
FIG. 3 shows the device with a current mirror arrangement in more detail.

FIG. 3 shows the device with a current mirror arrangement in more detail. It comprises a current set resistor RSET, an operational amplifier 301 with a positive input, a negative input and an output, a class AB gate driver 302 (with an input and outputs, selected leg gate biasing set voltages, 303 and 304), switching arrangements 305 (with input SET1 and output DRV1) and 306 (with input SET2 and output DRV2), PMOS transistors 307 to 312, NMOS transistors 313 to 318 and cascode arrangements 319 and 320 for selected input legs and selected output legs, respectively, of the current mirror. So for applications that require a high output voltage or high impedance, the transistors 307 to 312 in the current mirror legs may be cascoded or degenerated by corresponding resistors to increase impedance and decrease the variability of the output current. The cascode arrangements 319 and 320 may also DC-level shift the value of the voltage across an resistor RSET which may either be off-chip or on-chip depending on the accuracy needs and whether there is any calibration during test. The cascode arrangements 319 and 320 may even be gain boosted as shown in FIG. 3 and the gain booster being biased by a circuit not shown in FIG. 3. Or the cascode arrangements 319 and 320 may be directly biased and have no gain boosting. In an alternate embodiment of this circuitry, each of the current legs may have a cascode.

The current set resistor RSET is connected across the negative input of a regulating driver amplifier 301 and ground GND. The positive input of the driver 301 is connected to a control voltage Vin. The output of the amplifier 301 is connected to the input of the class AB gate driver 302. A first output 303 of the class AB gate driver 302 is connected to the Gates of the PMOS transistors. A second output 304 of the class AB gate driver 302 is connected to the Gates of the NMOS transistors. The voltages on nodes 303 and 304 are selected leg(s) biasing set voltages that drive the all the Gates of the corresponding set of PMOS and NMOS transistors, respectively, of the selected current mirror legs. The Sources of the PMOS transistors are connected through a resistor to a positive supply rail $V_P$, and the Sources of the NMOS transistors are connected via a resistor to a negative supply rail $V_N$. The Drain of each PMOS transistor is connected to the switching arrangement 305 and the Drain of each NMOS transistor is connected to the switching arrangement 306.

The cascode arrangement 319 has an input node SET1 connected to the first output of the switching arrangement 305, an input node SET2 connected to the first output of the switching arrangement 306, and a central node SET connected to the negative input of the amplifier 301. The cascode arrangement 320 has a first input node DRV 1 connected to the second output of the switching arrangement 305, a second input node DRV2 connected to the second output of the switching arrangement 306 and a central node DRV to which the output load is connected. The cascode arrangements 319 and 320 provide for the required potential shift to allow a high voltage output up to, e.g., in the range of 12 to 100 Volt. Together with a current source connected to the node SET, the amplifier 301 and the gate driver 302 constitute a driver that forces a reference current $_{ISET}$ to flow through resistor RSET in a closed loop configuration. The reference current 'SET is mirrored to each of the current sources 307 to 312 and 313 to 318, which is connected to the node DRV.

In operation, each switching arrangement 305 and 306 connects a predetermined number of current sources to the input leg of the current mirror, i.e. the switching arrangement 305 connects at least one current source 307 to 312 to the node SET1 and the switching arrangement 306 connects at least one current source 313 to 318 to the node SET2. The remaining current sources are connected to the output leg of the current mirror, i.e. the switching arrangement 305 connects all other current sources out of the current sources 307 to 312 to the node DRV 1 and the switching arrangement 306 connects all other current sources 313 to 318 to the node DRV2. The actual current sources that are connected to the nodes SET1 and SET2 and to the nodes DRV1 and DRV2 of the current mirror change each clock-cycle, whereas the ratio of the number of current sources within each group remains constant as long as no change of the current gain is requested. The current gain of the current mirror is defined by the number of current sources connected to the input leg of the current mirror divided by the number of current sources connected to the output leg of the current mirror (current gain ratio). The node DRV can be directly connected to an (external) load.

Figure 4:
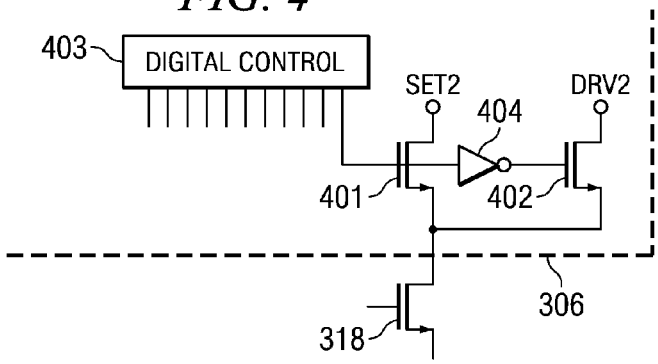
FIG. 4 shows details of the switching arrangement for selectively switching a particular current source either to a set terminal or to a driver terminal.

FIG. 4 shows how a particular current source 318 is controlled by a digital switching control 403. The current source 318 has two switches 401 and 402 in its Drain. The switch 401 can connect the current source 318 to the node SET2, the switch 402 can connect it to the node DRV2 depending on the digital switching control 403 driving the switches. As the switches 401 and 402 are controlled by the same output of the digital switching control 403, but switch 402 is connected through an inverter 404, it is ensured that the current source 318 is connected either to the node SET2 or to the node DRV2.

Figure 5:
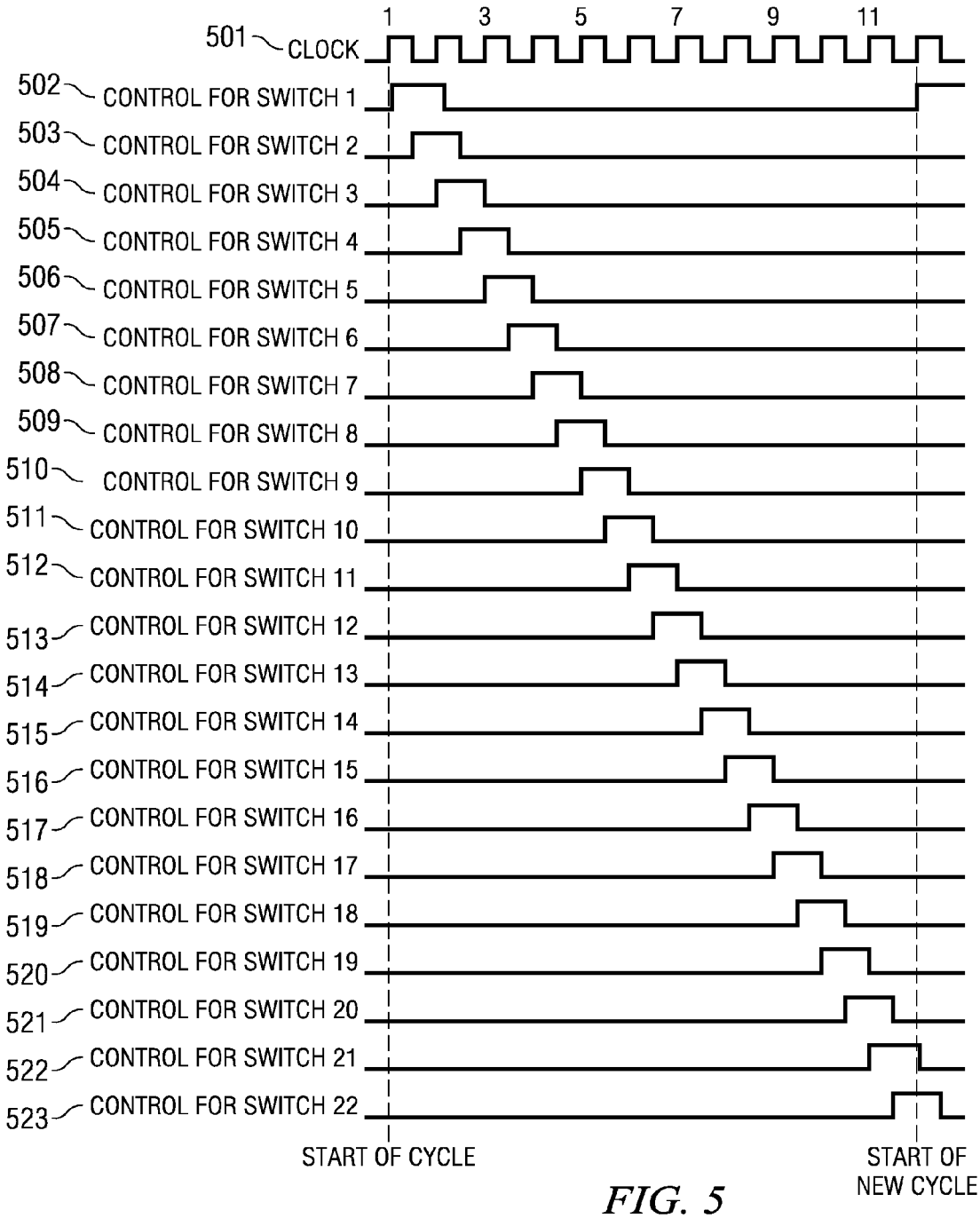
FIG. 5 is a chart that shows the timing of a switching arrangement.

FIG. 5 shows a example of how the switches can be controlled. A signal 501 represents the clock. Remaining signals 502 to 523 each show a control signal to be applied to the switching arrangement in order to control a current source. Thus, each signal 502 to 523 can be applied to the switches of FIG. 4. Looking at the scenario shown in FIG. 3 and assuming that the ratio of the current gain is 1:10, this leads to two current sources connected to the input leg of the current mirror and the remaining 20 current sources connected to the output leg of the current mirror.

Figure 6:
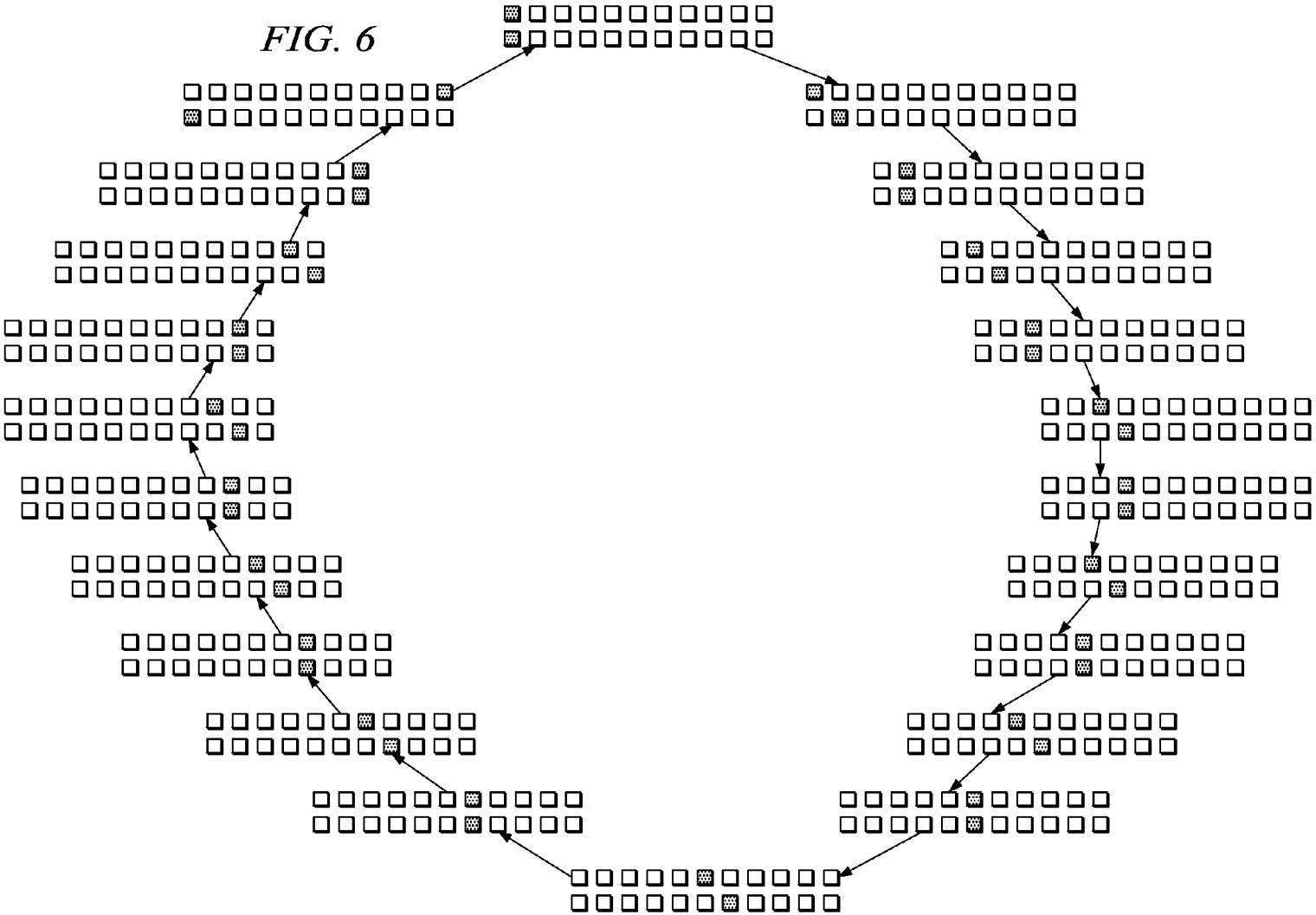
FIG. 6 is a state machine representation of a complete cycle of the switching arrangement.

FIG. 6 shows a state machine representation of the scenario set forth above. There are 11 PMOS transistors and 11 NMOS transistors, each represented by a small square in FIG. 6. The filled squares show the current sources connected to the input leg (SET node) of the current mirror and the other squares show the current sources connected to the output leg (DRV node) of the current mirror. Hence, at each state, two current sources are connected to the SET node and 20 current sources are connected to the DRV node. The first row in each state shows the p-type current sources, the second row shows the n-type current sources. Each state-change is indicated by an arrow pointing to the subsequent state. The state-change is triggered by the clock as described above.

The invention claimed is:

1. A voltage controlled current source with a control voltage input and a load current output, comprising:

a current set terminal for coupling to a current set resistor;

a regulating driver for setting gate bias voltages for transistors in selected current legs, corresponding to a control voltage applied to the control voltage input of the regulating driver, and for providing a regulated voltage across the current set resistor, thereby allowing a reference current to flow through the current set resistor and also to flow through at least one selected current leg; and a current mirror comprising the selected current legs that mirror the reference current to the load current output;

wherein the current mirror includes multiple current legs all having the same gate bias voltages supplied by said regulating driver, at least one of said selected current legs being coupled to conduct said reference current to said current set resistor; the current mirror further includes switches coupled between each current leg and the current set resistor; and other switches coupled between each current leg and the load current output.

2. The device according to claim 1, wherein other current legs are coupled to mirror the reference current to the load current output.

3. The device according to claim 2, wherein a clock-controlled switching circuit that permutates a selection of the at least one current leg among multiple current legs to couple and reflect said reference current, through other current legs in the current mirror.

4. A voltage controlled current source with a control voltage input and a load current output, comprising:

a current set terminal for coupling to a current set resistor;

a regulating driver for setting gate bias voltages for transistors in selected current legs, corresponding to a control voltage applied to the control voltage input of the regulating driver, and for providing a regulated voltage across the current set resistor, thereby allowing a reference current to flow through the current set resistor and also to flow through at least one selected current leg; and a current mirror comprising the selected current legs that mirror the reference current to the load current output;

wherein the current mirror comprises multiple current legs of said current mirror comprising an input current legs group coupled to conduct said reference current to said current set resistor; and wherein the current mirror further comprises multiple other current legs of said current mirror comprising an output current legs group coupled to the input current legs group, to mirror the reference current to the load current output.

5. The device according to claim 4, wherein a clock-controlled switching arrangement is provided that permutates a choice of at least one current leg of each said group among all of the current legs to couple to the current set resistor and to conduct said reference current.

6. The device according to claim 4, wherein all current legs of the input current legs group are coupled to all current legs of the output current legs group to mirror the reference current to the load current output; and the gate bias voltages for transistors are the same for both said groups.

7. The device according to claim 4, wherein the switching arrangement comprises MOSFET transistors.

8. The device according to claim 1, wherein a clock-controlled switching arrangement is provided that permutates a choice of at least one current leg of each said group among all of the current legs to couple to the current set resistor and to conduct said reference current.

9. A voltage controlled current source with a control voltage input and a load current output, comprising:

a current set terminal for coupling to a current set resistor;

a regulating driver for setting gate bias voltages for transistors in selected current legs, corresponding to a control voltage applied to the control voltage input of the regulating driver, and for providing a regulated voltage across the current set resistor, thereby allowing a reference current to flow through the current set resistor and also to flow through at least one selected current leg; and a current mirror comprising the selected current legs that mirror the reference current to the load current output;

wherein the current mirror includes multiple current legs at least one of which is an input current leg coupled to the current set resistor and at least another of which is an output current leg coupled to the load current output; the ratio between a number of the at least one input current leg and a number of output current legs is adjustable by a fixed pattern.

10. A voltage controlled current source with a control voltage input and a load current output, comprising:

a current set terminal for coupling to a current set resistor;

a regulating driver for setting gate bias voltages for transistors in selected current legs, corresponding to a control voltage applied to the control voltage input of the regulating driver, and for providing a regulated voltage across the current set resistor, thereby allowing a reference current to flow through the current set resistor and also to flow through at least one selected current leg; and a current mirror comprising the selected current legs that mirror the reference current to the load current output;

wherein the current mirror includes multiple current legs at least one of which is an input current leg coupled to the current set resistor and at least another of which is an output current leg coupled to the load current output; the ratio between a number of the at least one input current leg and a number of output current legs is adjustable by a pseudo-random pattern.

11. The device according to claim 8, wherein the switching arrangement comprises MOSFET transistors.

12. The device according to claim 4, wherein the current mirror comprises a first cascade circuit coupled to the input current legs group for cascoding the transistors and a second cascode circuit coupled to the output current legs group for cascoding the transistors.

13. The device according to claim 12, wherein the transistors comprise MOSFET transistors.

14. The device according to claim 13, wherein the transistors are degenerated by corresponding resistors.

15. The device according to claim 4, wherein the current setting resistor may be on chip.

16. A voltage controlled current source with a control voltage input and a load current output, comprising:

a current set terminal for coupling to a current set resistor;

a regulating driver for setting gate bias voltages for transistors in selected current legs, corresponding to a control voltage applied to the control voltage input of the regulating driver, and for providing a regulated voltage across the current set resistor, thereby allowing a reference current to flow through the current set resistor and also to flow through at least one selected current leg;

a current mirror comprising the selected current legs that mirror the reference current to the load current output;

switches coupled between each current leg and the current set resistor;

switches coupled between each current leg and the load current output; and a clock-controlled switching circuit coupled to the switches for selecting the current legs.

17. A voltage controlled current source with a control voltage input and a load current output, comprising:

a current set terminal for coupling to a current set resistor;

a regulating driver for setting gate bias voltages for transistors in selected current legs, corresponding to a control voltage applied to the control voltage input of the regulating driver, and for providing a regulated voltage across the current set resistor, thereby allowing a reference current to flow through the current set resistor and also to flow through at least one selected current leg;

a current mirror comprising the selected current legs that mirror the reference current to the load current output;

switches coupled between each current leg and the current set resistor;

switches coupled between each current leg and the load current output;

a clock-controlled switching circuit coupled to the switches for selecting the current legs; and the regulating driver comprises an amplifier with feedback for providing the regulated voltage; the regulating driver further comprises a class AB driver coupled to an output of the amplifier for generating a first and second gate bias voltage.

18. The device of claim 17, wherein each current leg comprises a source transistor having a gate, drain and source and a pull down transistor having a gate, drain and source; the first gate bias voltage couples to the gate of the source transistor; and the second gate bias voltage couples to the gate of the of the pull down transistor.

* * * * *